US006182853B1

(12) United States Patent
Julien

(10) Patent No.: US 6,182,853 B1
(45) **Date of Patent: *Feb. 6, 2001**

(54) PLASTIC DRUM

(75) Inventor: Robert A. Julien, Naperville, IL (US)

(73) Assignee: GCC Drum, Inc., Franklin Park, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/255,056

(22) Filed: Feb. 22, 1999

(51) Int. Cl.[7] ..... B65D 6/34

(52) U.S. Cl. ..... 220/649; 220/606; 220/605; 220/659; 220/634

(58) Field of Search ..... 220/659, 634, 220/636, 635, 649, 675, 657, 656, 771, 752, 606, 605, 604, 4.05

(56) References Cited

U.S. PATENT DOCUMENTS

| | | | | |
|---|---|---|---|---|
| 2,673,010 | | 3/1954 | Barrow . | |
| 3,840,141 | | 10/1974 | Allom et al. . | |
| 3,889,839 | * | 6/1975 | Simon et al. | 220/675 |
| 3,934,747 | | 1/1976 | Needt . | |
| 3,955,705 | | 5/1976 | Dubois et al. . | |
| 4,117,062 | | 9/1978 | Uhlig . | |
| 4,140,236 | | 2/1979 | Uhlig et al. . | |
| 4,169,537 | | 10/1979 | Sabreen et al. . | |
| 4,228,122 | | 10/1980 | Hammes . | |
| 4,228,911 | | 10/1980 | Hammes . | |
| 4,252,585 | | 2/1981 | Raabe et al. . | |
| 4,257,527 | | 3/1981 | Snyder et al. . | |
| 4,293,080 | * | 10/1981 | Letica | 220/790 |
| 4,294,374 | | 10/1981 | Ames . | |
| 4,349,119 | * | 9/1982 | Letica | 220/790 |
| 4,412,628 | | 11/1983 | Whitney . | |
| 4,643,323 | | 2/1987 | Schutz . | |
| 4,674,648 | | 6/1987 | Przytulla . | |
| 4,713,207 | | 12/1987 | Udell et al. . | |
| 4,736,862 | | 4/1988 | Hammes et al. . | |
| 4,768,673 | * | 9/1988 | Przytulla | 220/649 |

(List continued on next page.)

FOREIGN PATENT DOCUMENTS

| | | |
|---|---|---|
| B1 15436176 | 1/1978 | (AU) . |
| 819446 | 12/1974 | (BE) . |
| 7412047 | 7/1974 | (DE) . |
| 1 0 210 679 | 6/1986 | (EP) . |
| WO 88/00128 | 6/1987 | (EP) . |
| 1 0 324 882 | 1/1988 | (EP) . |
| 1 429 754 | 5/1974 | (GB) . |
| 1 535 287 | 7/1976 | (GB) . |
| 2 137 158A | 10/1984 | (GB) . |
| 61-93038 | 5/1986 | (JP) . |
| 8400951 | 3/1984 | (NL) . |

* cited by examiner

*Primary Examiner*—Stephen Castellano
(74) *Attorney, Agent, or Firm*—Brinks, Hofer, Gilson & Lione

(57) ABSTRACT

The present invention is directed to a plastic drum that includes a cylindrical shaped sidewall and a planar shaped head. A transition section is molded with and disposed between the head and the sidewall. A handling ring is positioned on the transition section and has a base that is disposed below the head and interior to the sidewall. The plastic drum is formed by the steps of: providing a mold having an inner surface that defines a cylindrical shaped sidewall, a planar shaped head, a transition section between the sidewall and the head and a handling ring; and molding a sidewall and the head, a transition section between the head and the sidewall, and a handling ring to extend from the transition section, the handling ring being positioned on the transition section below the head and interior to the sidewall.

14 Claims, 4 Drawing Sheets

U.S. PATENT DOCUMENTS 4,925,049 * 5/1990 Przytulla ..... 220/675
4,962,863 * 10/1990 Wendling et al. ..... 220/649
5,018,641 * 5/1991 Carpenter, Jr. et al. ..... 220/634
5,033,639 7/1991 Przytulla .
5,259,526 11/1993 Stolzman .
5,273,181 * 12/1993 Gay ..... 220/601
5,425,454 * 6/1995 Przytulla et al. ..... 206/509
5,449,087 9/1995 Mikula et al. .
5,543,107 8/1996 Malik et al. .
5,918,757 * 7/1999 Przytulla et al. ..... 220/288
6,024,245 * 2/2000 Malik et al. ..... 220/604
6,026,980 * 2/2000 Malik et al. ..... 220/604
B1 5,033,639 5/1993 Przytulla .

200
240
248
249
30
20
21
22
44
45
48
50
51
42
64
66
62
68
70
53
57
59
54
80
82
56
61
B
41
49
40
46
13
10
1
2
4
11
24

PLASTIC DRUM

FIELD OF THE INVENTION

The present invention relates to the field of plastic drums, and in particular to a plastic drum having an integrally molded handling ring to provide a surface for lifting equipment such as a "parrot beak" to hold onto.

BACKGROUND OF THE INVENTION

Tighthead plastic drums are well accepted in the marketplace; they are used to contain and transport chemical, foodstuffs, and other liquids, both hazardous and non-hazardous. The drum ratings required for these products are dictated by DOT regulation and UN recommendations. The regulations mandate that a particular drum design must withstand breakage during certain drop tests, withstand a particular amount of deflection during loading tests and withstand leakage during pressure testing. Drop testing includes dropping a drum multiple times on its side and dropping the drum multiple times on its top corner from a height that depends on the desired drum rating. Pressure testing includes applying a hydrostatic pressure within the drum that depends on the desired drum rating. Further, in the United States, drums must be capable of being handled individually in order to be commercially successful, and therefore drums are commonly provided with handling rings.

Tighthead plastic drums are a commodity product. Performance specifications are well-known and current technology can produce a reliable product. Due to the commodity nature of these drums, minimizing cost against a relatively low fixed price ceiling is crucial to the profitability of the manufacturer. Because so much of the cost of producing a plastic drum is concentrated in the resin from which the drum is made, particular care must be taken in design and manufacturing to minimize the amount of resin used to make a drum that meets regulation requirements.

Tighthead plastic drums are shipped in ISO-containers and semi-trailers, among other modes. In these containers, sizing has been standardized so that quantity is maximized if the drums are sized properly with respect to their diameter. If not, shipping costs are increased, making the drums less commercially valuable.

Early embodiments of the tighthead plastic drums had detachable handling rings. Ordinarily, lifting devices such as parrot beaks squeeze such handling rings in order to lift and handle filled plastic drums. The drums can also be lifted and handled using other methods such as forklift tines. Eventual plastic technological advances allowed the handling ring to be constructed integrally with the drum as a single piece construction. Providing an integral handling ring avoids a heavy investment in molds and molding machines. During the molding process of integrally molded drums, the handling ring of the drum is compression molded, resulting in the formation of a weld line and also resulting in large quantities of excess material or extrudate being pushed into the interior of the drum below the weld line. Breakage of the drum often occurs in this weld area.

The tendency of a drum to break depends in part upon the location of the handling ring and the internal geometry of the drum, which to an extent is also a function of the location of the handling ring. The points of weakness where drums are generally susceptible to fracture generally occur at the transitions between sections of differing thickness, or at points where the vessel walls change direction. Further, in molding plastic it is best to avoid creating stress initiation points which can be formed in internal comers that are sharply angled or in areas with small radiuses. These stress initiation points especially render a drum susceptible to breakage when they are located in parts of the drum that are exposed to high levels of stress during an impact event.

In some cases drums are designed so that the intersection of the head and sidewall of the drum define the location of the handling ring and thus the location of the critical weld line and the extrudate material. In another design, disclosed in U.S. Pat. No. 5,033,639 (Przytulla) a handling ring is located at or integral with a point where the sidewall meets a frustoconical transition section between the head and the sidewall of the drum. A schematic representation of this configuration is shown in FIG. 11. FIG. 11 includes a representation showing where extrudate 7 is formed within the drum as a result of compression molding the handling ring.

The location of extrudate material, caused by the molding process, is dependent on the location of the handling ring and in this case the extrudate is in part disposed along the interior of the sidewall. The formation of extrudate material creates a heavy section at this location. Such heavy sections are generally less flexible than thinner sections because they are more crystalline, whereas the plastic in the thin sections is more amorphous. In the drum design of FIG. 11 the heavy section is disposed in an area of high stress concentration, and thus in an impact situation will cause a drum to fracture more easily. Further, the extrudate material may have been formed so that it has stress initiators in the form of internal corners with sharp angles formed therein. In this case, the stress initiators can especially render a drum more susceptible to breakage because they are positioned in an area that is subject to high stress concentration during an impact event.

Another example of an integrally molded handling ring is disclosed in U.S. Pat. No. 5,543,107 (Malik et al.). A schematic representation of the Malik et al. handling ring is shown in FIG. 12. Malik et al. discloses a handling ring that is located in direct contact with the flat head surface of the drum. As discussed above, this design increases the chance of breakage because the handling ring is located near a transition point of two sections of varying thickness. In addition, the handling ring is molded so that the extrudate material forms a geometry referred to as a double ogee 5. This geometry is intended to eliminate acute angles formed in the extrudate which could act as stress initiation points. The formation of the geometry disclosed in this patent, however, requires a complex molding process. Further, such a location of the handling ring as disclosed in Malik et al. requires a relatively thick head portion of the drum in order to get enough extrudate to form the double ogee. The formation of the ogee itself and the formation of the thick head section requires more material, which adds to the cost of manufacture of the drum. In addition this design disposes the extrudate at an area of high stress concentration which has the disadvantages associated with heavy sections and stress initiation points discussed above.

Accordingly, it is desirable to provide a handling ring monolithically molded to a plastic drum that is located in a position that results in a drum that is less susceptible to fracture and that affords an internal geometry that reduces the chance of drum breakage. Further, it is desirable to provide such a handling ring that is simple and cost efficient to manufacture.

BRIEF SUMMARY OF THE INVENTION

A new and unique plastic drum has been invented that overcomes many of the deficiencies noted above.

In a first aspect the invention is a drum that includes a cylindrical shaped sidewall and a planar shaped head. A transition section is molded with and disposed between the head and sidewall. A handling ring having a base is positioned on the transition section so that the base is disposed below the head and interior to the sidewall.

In another aspect, the invention is a plastic drum formed by the steps of: providing a mold having an inner surface that defines a cylindrical shaped sidewall, a planar shaped head, a transition section between the sidewall and the head and a handling ring; and molding a sidewall and the head; a transition section between the head and the sidewall, and a handling ring to extend from the transition section, the handling ring being positioned on the transition section below the head and interior to the sidewall.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE INVENTION

Figures 1, 2, 3:
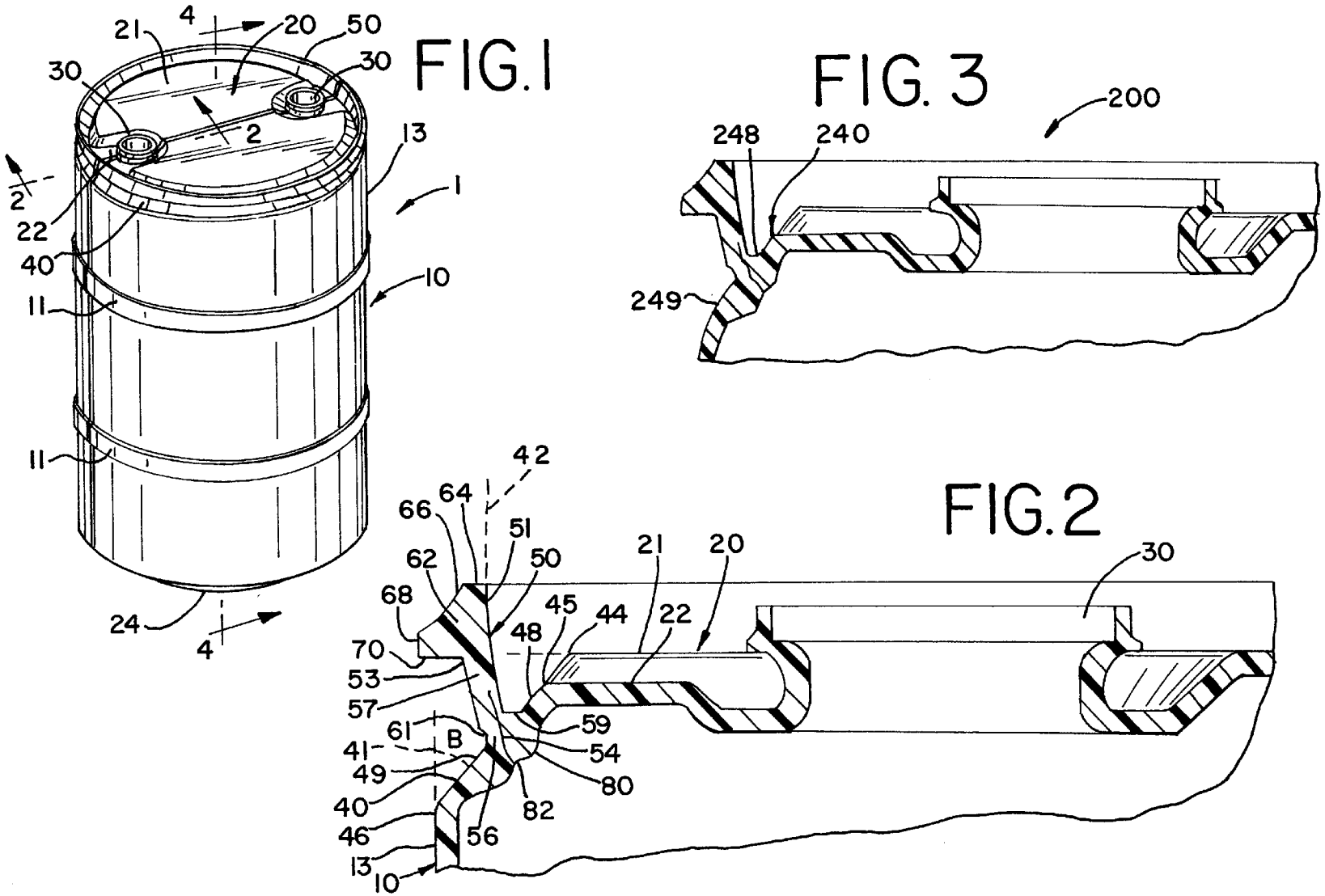
FIG. 1 is a perspective view of a preferred embodiment of the present invention.
FIG. 2 is a partial sectional view taken along line 2—2 of FIG. 1.
FIG. 3 is a partial sectional view of an alternative embodiment of the present invention.

Referring to FIG. 1, there is shown a drum 1. In one embodiment, the drum 1 is a plastic drum similar to a plastic drum designed by General Cooperage Company, of Franklin Park, Ill. The drum 1 is generally formed from a sidewall 10, a head 20, a bottom 24 and a transition section 40 that are monolithically molded together. In this case monolithic is defined as formed of one piece or a one-piece construction. The sidewall 10 has a generally cylindrical shaped outer surface 13 and the head 20 has a generally planar top surface 21. The head 20 includes bung bosses 30 disposed in a recessed portion 22 of the head for lading product within the drum 1.

As shown in FIGS. 1 and 2, the transition section 40 is formed in between the sidewall 10 and the head 20. A handling ring 50 is preferably monolithically molded with and extends upward from the transition section 40. This handling ring 50 serves to provide an appurtenance for lifting equipment to grasp the drum 1. This handling ring 50 is positioned on the transition section 40 in a manner that reduces the chance of breakage of the drum 1 during an impact event. Also, the location of this handling ring 50 decreases the cost to manufacture the drum 1.

Referring to FIG. 2, the transition section 40 has an upper end 44 and a lower end 46. In a preferred embodiment the transition section 40 slopes downward from the head 20 to the sidewall 10. A first portion 48 of the transition section 40 is formed between the upper end 44 and the handling ring 50 and a second portion 49 of the transition section is formed between the handling ring 50 and the lower end 46. Referring again to FIG. 2, in a preferred embodiment an acute angle B is formed between a vertical axis 41 oriented along the outer surface 13 of the sidewall 10 and the outer surface of the transition section 40. In a preferred embodiment this angle B is about 45 degrees. Alternatively, other angles may be used, such as but not limited to between approximately 30 degrees and 60 degrees.

As shown in FIGS. 1 and 2, recessed portions 22 of the drum 1 accommodate the bung bosses 30. In the recessed portions 22 of the drum 1 the top portion of the transition section 40 extends to a top end 45 which corresponds to the recessed portion 22. The geometry of the transition section 40 in this recessed portion 22 is generally the same as that discussed above.

Referring to FIG. 2, the handling ring 50 is monolithically formed with and extends upward from the transition section 40. The handling ring preferably has an inner surface 51 and an outer surface 53. In a preferred embodiment, the handling ring 50 extends around the entire transition section 40. In a preferred embodiment, the handling ring 50 forms an obtuse angle with respect to the second portion 49 of the transition section 40. The handling ring 50 includes a base 56, a middle portion 57 and a head 62. The base 56 is defined generally as the portion of the handling ring that meets the transition section 40. The handling ring 50 inner surface 51 meets the transition section 40 at a first intersection 59 and the handling ring 50 outer surface 53 meets the transition section 40 at a second intersection 61. In a preferred embodiment, the first intersection 59 is located below the generally planar top surface 21, and the second intersection is located interior to the cylindrical outer surface 13 of the sidewall 10. The head 62 includes a top surface 64, a curved edge 66, an outside edge 68 and a bottom surface 70.

The first intersection 59 allows the handling ring 50 to flex over a larger area, thus allowing the handling ring 50 to absorb more energy, and reduces stress at the first intersection 59 during an impact event.

Referring again to FIG. 2, the handling ring 50 is generally located between the upper end 44 and the lower end 46 of the transition section 40. The handling ring 50 is preferably located approximately at the midpoint between the upper end 44 and the lower end 46. In a preferred embodiment the top surface 64 is located a vertical distance of 1.162 inches above the first contact point 59. The bottom of the outside edge 68 is preferably located a distance of about 0.608 inches from the top surface 64 and the top of the outside edge 68 is preferably located a vertical distance of about 0.422 inches from the top surface.

In a preferred embodiment, the inner surface 51 of the handling ring 50 is tilted approximately 11 degrees with respect to a vertical axis 42 that is defined by the vertical dashed line shown in FIG. 2. The outer surface 53 is preferably tilted about 12 degrees with respect to the vertical axis 42. Alternatively, if the location of the handling ring 50 is changed these angles will change accordingly. In a preferred embodiment the outer diameter of the handling ring 50 as defined by the outermost point of the handling ring 50, the outside edge 68, is less than or equal to the outer most diameter of the drum 1, which is defined by the rolling hoops 11, shown in FIG. 1. This dimensioning is important for storage purposes because it allows drums to be stacked immediately adjacent to each other. In a preferred embodiment the handling ring 50 forms an obtuse angle with respect to the second portion 49 of the transition section 40.

Referring again to FIG. 2, a weld line 54 is illustrated by the line on the handling ring 50. The weld line 54 in the handling ring 50 is formed as a result of the molding process, which involves pressing two pieces of molten plastic material together to form the handling ring 50. This molding process is discussed in greater detail below.

As shown in FIG. 2, extrudate 80 is integrally formed at the base or root 82 of the weld line 54. The extrudate 80 is formed from extra material being pushed into the interior of the drum 1 during the compression molding of the handling ring 50. The extrudate 80 is distributed generally evenly in the shape of the two bumps shown in FIG. 2. The portion of the transition section 40 where the handling ring 50 is formed, and as a result where the extrudate 80 is located, is preferably two times thicker than the average thickness of the head 20 and of the sidewall 10.

In a preferred embodiment, the drum is made of a plastic such as high molecular weight high density polyethylene (HMWHDPE). Alternative materials such as Polyethylene Terephthalate (PET), Polycarbonate (PC), Polypropylene (PP) and Polyethylene (PE) could also be used. Additionally, these materials and others filled with fiberglass, mica, wood or paper fiber and other blends could be used.

The drum 1 is preferably up to 120 gallons in capacity. Further, the drum 1 is preferably dimensioned so as to efficiently fit into standard shipping containers. Alternatively, the drum may be anywhere between 15–120 gallons in capacity.

Figure 4:
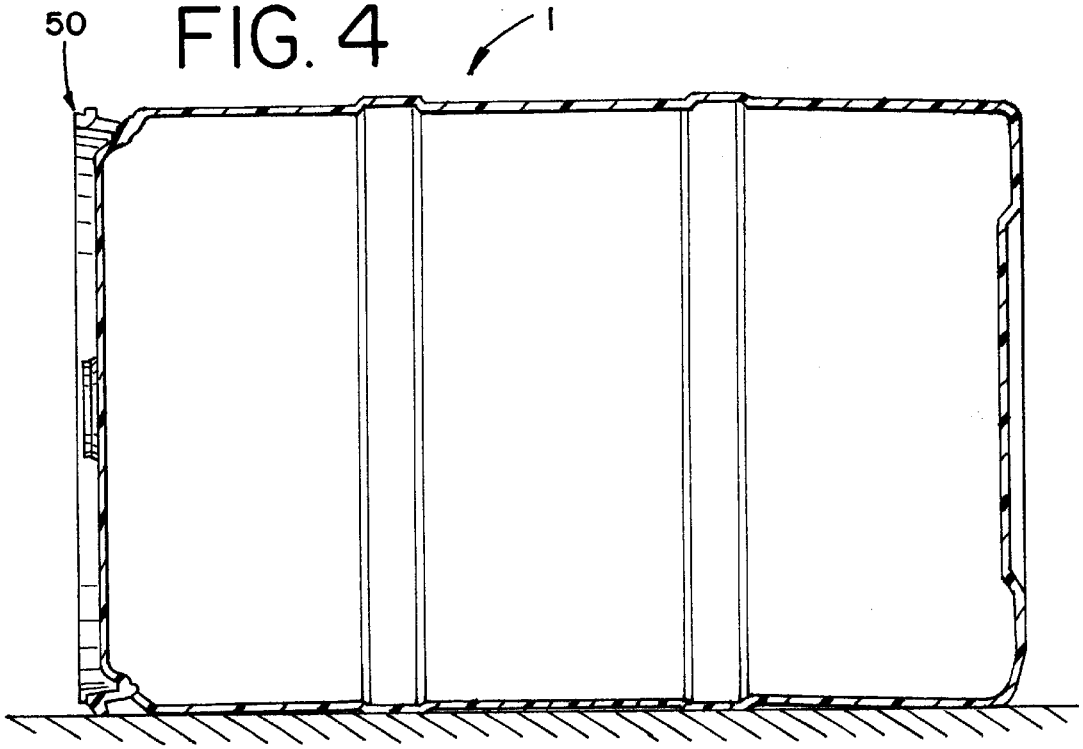
FIG. 4 is a sectional view of the drum shown in FIG. 1 taken along line 4—4 showing the drum tipped or dropped onto its side.
Figure 5:
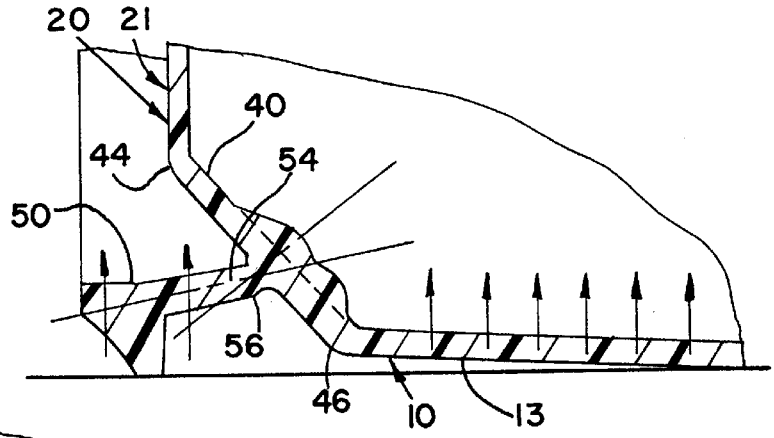
FIG. 5 is an exploded view of the handling ring of the drum in FIG. 4 in an initial state of deformation.
Figure 6:
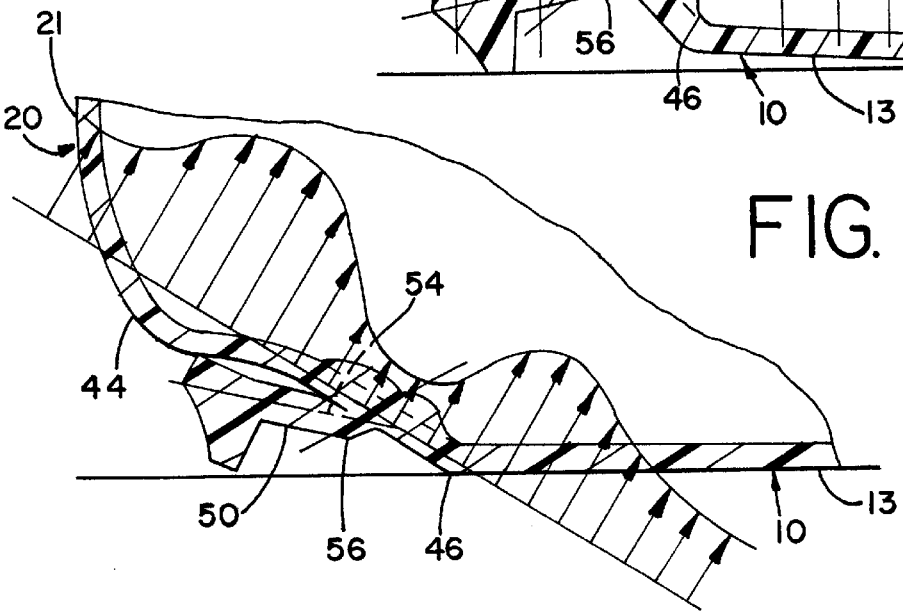
FIG. 6 shows the handling ring of FIG. 5 in a further state of deformation.

The advantages of the invention will now be described in the context of the effects of dropping a plastic drum 1, which will be described with reference to FIGS. 4–6. Referring to FIGS. 4 and 5, a plastic drum filled with liquid products has either been dropped or tipped onto its side.

When a drum 1 is dropped onto its side, it generally experiences two types of forces, an external ground impact force on the sidewall 10 and internal hydraulic forces on the head, sidewall and bottom of the drum 1. During the course of the impact the forces begin to flatten out the drum 1 and bend the handling ring 50 in an ovalized fashion as well as cause it to flex in towards the head of the drum 1. In particular, the hydraulic forces tend to stress the joint where the sidewall 10 meets the transition section 40 and the head 20 meets the transition section 40. As shown schematically by the arrows in FIG. 6, the critical stresses caused by these forces are generally located at the upper 44 and lower 46 ends of the transition section 40.

Figure 11:
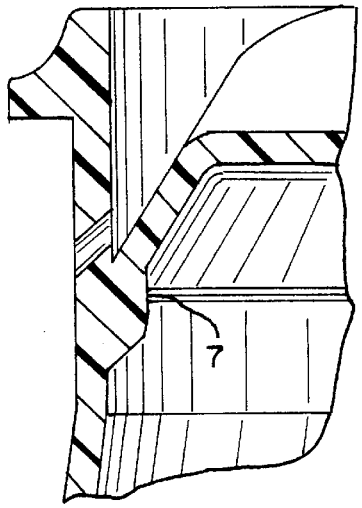
FIG. 11 PRIOR ART
FIG. 11 shows a drum from FIG. 1 of U.S. Pat. No. 5,033,639 and further includes a representation of extrudate material formed within the drum.
Figure 12:
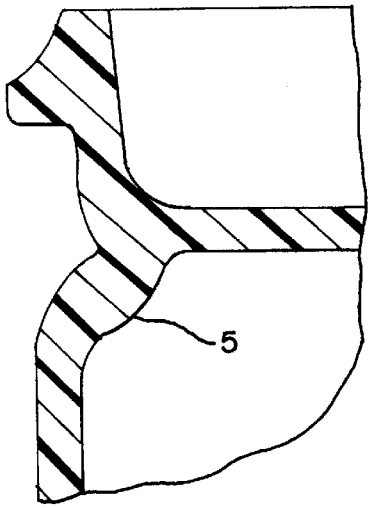
FIG. 12 PRIOR ART
FIG. 12 shows a portion of a drum as depicted in FIG. 2 of U.S. Pat. No. 5,543,107.

An advantage of the present embodiment of the invention is that the handling ring 50 is located at a point between the upper 44 and lower 46 ends, as opposed to being situated at the upper end 44 or the lower end 46 of the transition section 40. More specifically, a base 56 of the handling ring 50 is located below the generally planar top surface 21 formed by the head 20 and interior to the cylindrical outer surface 13 of the sidewall 10. The chance of drum 1 breakage is substantially reduced by this location of the handling ring 50 because the extrudate 80, which includes masses of crystalline material and possible stress initiation points is not located at a point where the critical stresses caused by impact are concentrated. If the handling ring 50 were located on or near the head 20 (as shown in FIG. 12), as opposed to below the head, or if the handling ring 50 were located on or near the sidewall 10 (as shown in FIG. 11), as opposed to interior to the sidewall 10, the extrudate would be directly subjected to the critical stresses during an impact event, which would increase the chances of drum 1 breakage.

An additional advantage is provided by the present preferred embodiment of the invention by the fact that the upper and lower ends 44, 46 of the transition section 40 are comprised of less material and are thinner than corresponding sections in the prior art embodiments where the handling ring is formed at the upper or lower ends of the transition section. The ends of the transition section are thinner because the extrudate material 80 formed in the interior of the drum below the handling ring 50 is located along the transition section 40 as shown in FIG. 2, as opposed to being located at either of the ends 44, 46, which would be the case if the handling ring 50 were located at the upper or lower end 44, 46 of the transition section 40, thereby causing thicker sections at these ends. In addition, the present embodiment of the invention permits a thinner head 20 than a head of a drum where the handling ring is formed at the upper end 44. These thinner areas can more easily be stretched and absorb energy during an impact event, thus relieving stresses on the critical weld area 54. Further, the thinner areas require less material or resin to manufacture and therefore result in a substantial cost savings and an overall lighter drum 1, resulting in a savings in manufacturing and shipping costs.

A further advantage of the present preferred embodiment of the invention is that it can more effectively bear a tensile load without breaking the ring. Handling rings that are substantially perpendicular to the head have a tendency to fracture more easily when a tensile load is applied, as opposed to the handling ring 50 of the present invention which is angled and thus able to more evenly distribute tensile load forces.

The fact that the handling ring 50 of the present invention is monolithically molded substantially reduces the cost of making the drum 1 and also reduces the weight of the drum.

Referring to FIG. 3, a second preferred embodiment of drum 200 of the present invention is shown. The device is generally the same as drum 1 of FIGS. 1–2 and the similar elements have similar reference numbers. The primary difference between the embodiment of FIGS. 1–2 and the embodiment of FIG. 3 is that in the second embodiment, the first portion 248 and the second portion 249 of the transition section 40 form curved surfaces. The curved surfaces join to form a continuous elliptical or radiused shaped transition area.

In a preferred embodiment, the drum 1 described in FIGS. 1–2 and 4–6 may be made using a blow mold and a blow molding technique described below with reference to FIGS. 7–11.

Figure 7:
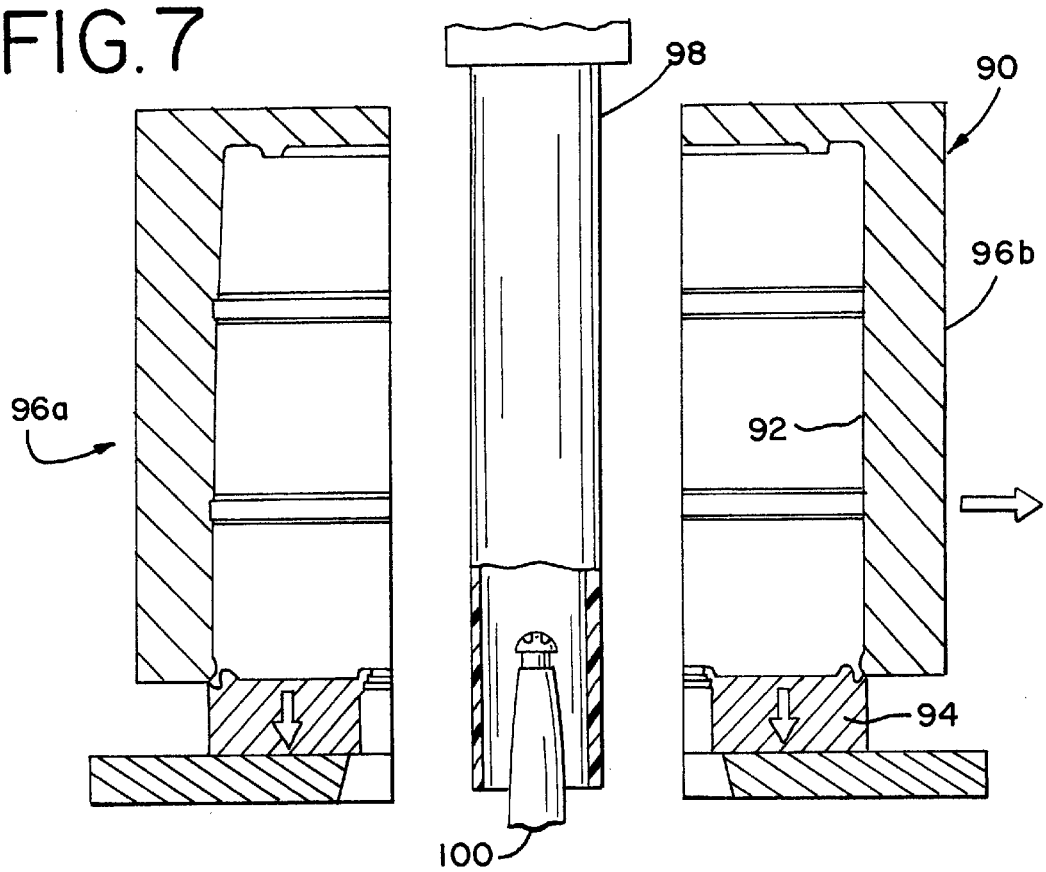
FIG. 7 is a schematic view illustrating the open position of a mold used to manufacture the drum of the present invention.
Figure 8:
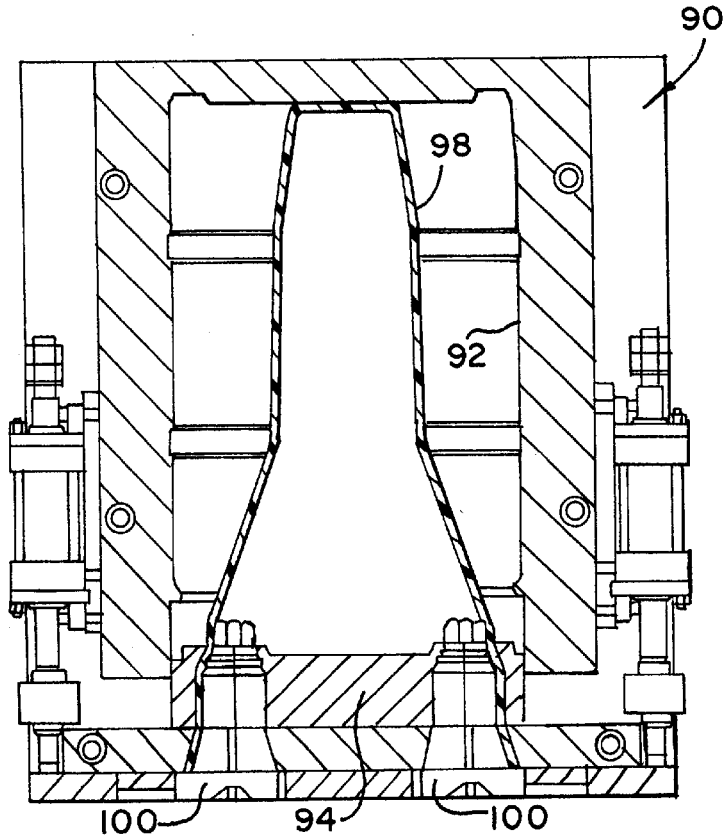
FIG. 8 is a schematic view of the mold of FIG. 7 illustrating a first molding step used in making the preferred embodiment of the present invention.

Referring to FIGS. 7–8, a blow mold 90 is shown. The blow mold 90 is positioned so that a drum can be formed in an upside down position. An interior surface 92 of the blow mold 90 is sized and shaped according to the drum to be molded. An articulating mold section 94 is initially disposed below the blow mold 90 and is used to compression mold a handling ring. In a preferred embodiment the handling ring is the handling ring 50 described in FIGS. 1 and 2 above. In a preferred embodiment the mold 90 is made of a material of substantially high thermal conductivity, such as aluminum, with inserts for special purposes made of materials such as steel and beryllium copper. Alternatively, the mold may be made of steel, nickel, titanium, wood or some other material which will withstand the stresses of blowing and compression.

As shown in FIG. 7, the mold is preferably divided into two halves 96*a*, 96*b* that are open in a first position. Disposed between the halves is a parison 98. The parison 98 is preferably disposed within the mold using extrusion. The parison 98 thickness is adjusted by programming extrusion die tooling. In a preferred embodiment the parison 98 is made of a HMWHDPE material. Alternately the parison may be made of Polyethylene Terephthalate (PET), Polycarbonate (PC), Polypropylene (PP) or medium or lower linear low density Polyethylene (PE). Blow pins 100 are disposed within the parison 98 and used to supply air to expand the parison 98.

The following steps are performed to mold a drum 1 using the blow mold 90. First, plastic is heated to a temperature within the range of about 385–500 degrees F. and the parison 98 is extruded out over the blow pins 100 or transferred there with a parison transfer device. Next, the mold halves 96*a*, 96*b* are closed to pinch off the parison 98, so that there is a closed parison 98 within the mold 90. Referring to FIG. 8, when the mold halves 96*a*, 96*b* are almost completely closed a preblow or a first blowing step is conducted in which air is blown through the blow pins 100 to expand the parison 98. Alternatively, other methods could be used to introduce air to expand the parison 98, such as needle blowing.

Figure 9:
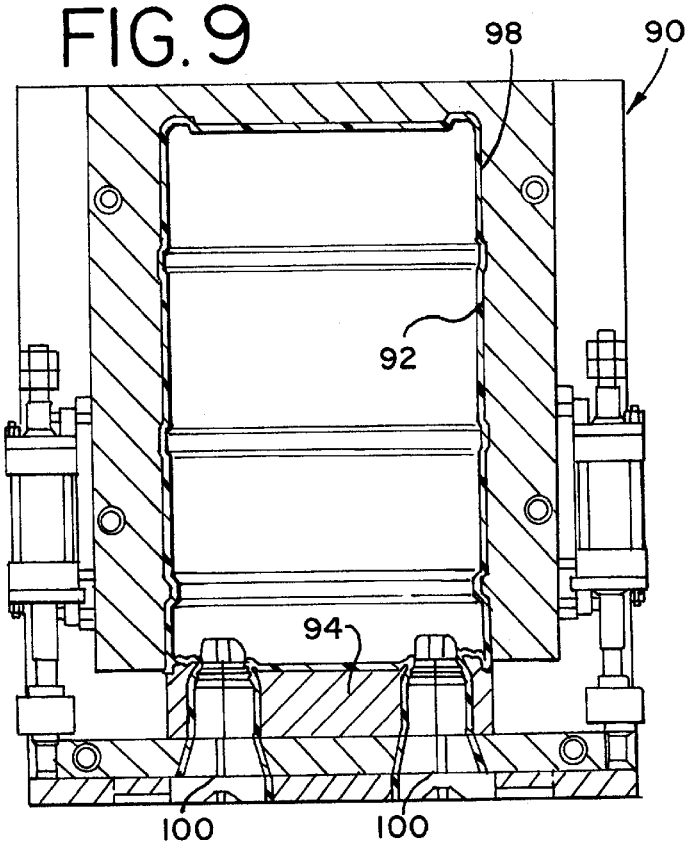
FIG. 9 is a schematic view of the mold of FIG. 7 illustrating a subsequent portion of the first step of the molding process.

Referring to FIG. 9, when the parison 98 is blown into the mold such that all of it is in contact with the mold 90, the articulating mold section 94 is raised up into the mold 90 body. When the articulating section 94 is closed, excess material forms the extrudate material 80 shown in FIG. 2. In a preferred embodiment, air is circulated in and out at a constant pressure. The articulating mold section 94 is preferably closed at a rate of about ½"–1"/second.

Figure 10:
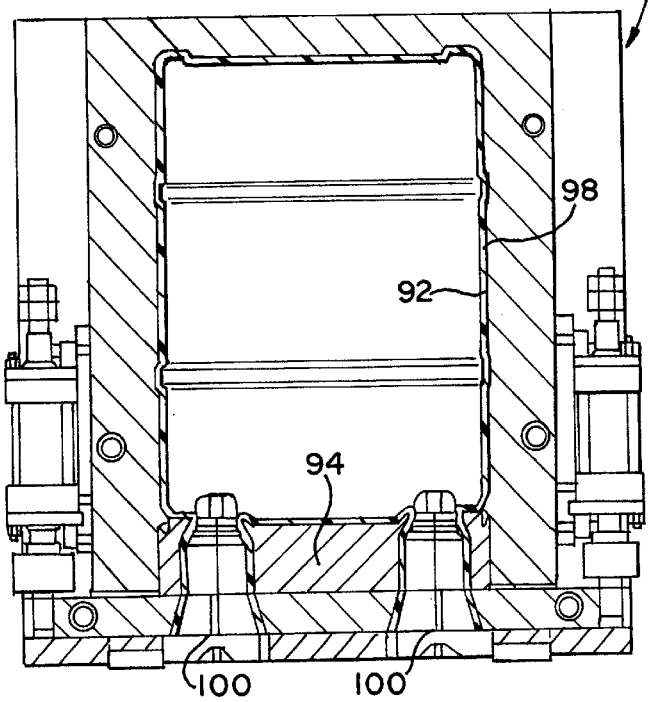
FIG. 10 is a schematic view of the mold of FIG. 7 illustrating a second molding step used to manufacture the preferred embodiment of the present invention.

Referring to FIG. 10, after the articulating mold section 94 is completely closed, a second blowing step is initiated. The second step also involves cycling cooled air or other cooling gasses through the blowing 100 long enough to allow the plastic drum 1 to cool sufficiently to remove it from the mold without deleterious deformation occurring. In a preferred embodiment the air is blown in at a pressure within the range of approximately 90 to 130 psi for a duration of about 60–90 sec. Alternatively, the volume of air circulated and the duration is varied depending upon environmental factors, including material density, ambient temperatures, cooling water temperatures, mold temperatures and other factors. After the drum 1 has cooled, the mold halves 96*a*, 96*b* and the mold articulating section can be opened and the drum 1 can be removed from the mold.

Using the above described method, a drum 1 having an integrally formed handling ring 50 described above is formed. The handling ring 50 of the drum 1 formed using the above-described method is located on the transition section 40 such that it provides the advantages discussed in detail above. Additionally the drum 1 made from the foregoing method can be shipped in standard ISO-containers and semi-trailers as well as other shipping modes.

In an alternative embodiment, a handling ring may be monolithically molded to the bottom of the drum as well as the head. Alternatively, a handling ring may be monolithically molded to only the bottom of the drum.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A drum comprising:

a generally cylindrical sidewall;

a generally planar head;

a transition section integrally molded as one piece with and disposed between the head and the sidewall, the transition section having a lower end connected to the sidewall and an upper end connected to the head;

a handling ring having a base positioned on the transition section between the upper end and the lower end, the base defining a first portion of the transition section between the upper end and the base and a second portion of the transition section between the base and the lower end, wherein the first portion is generally parallel with the second portion, and wherein the base of the handling ring forms an acute angle with respect to the first portion.

2. The drum of claim 1, wherein the sidewall defines a vertical axis oriented along the outer surface of the sidewall, and wherein the angle between the second portion and the vertical axis is between approximately 30 degrees and 60 degrees.

3. A drum, comprising:

(a) a cylindrical shaped sidewall and a generally planar shaped head;

(b) a transition section integrally molded as one piece with and disposed between the head and the sidewall, wherein the entire transition section is frustoconical; and (c) a handling ring having a base, the handling ring positioned on the transition section so that the base is disposed below the head and interior to the sidewall, wherein the base of the handling ring forms an obtuse angle with a portion of the transition section between the sidewall and the handling ring.

4. The drum of claim 3, wherein the handling ring is monolithically molded onto the transition section.

5. The drum of claim 3, wherein the transition section is curved.

6. The drum of claim 3, wherein the handling ring is positioned at a midpoint between the head and the sidewall.

7. The drum of claim 3, wherein a weld line is formed in the handling ring.

8. The drum of claim 3, wherein the handling ring forms an acute angle with respect to a portion of the transition section that is proximate the head.

9. The drum of claim 3, wherein the handling ring is integrally molded as one piece to the transition section.

10. The drum of claim 3, wherein the handling ring extends around the entire transition section.

11. The drum of claim 3, wherein a portion of the transition section that intersects the handling ring is approximately 2 times thicker than the average thickness of the head and the sidewall.

12. A drum, comprising:

(a) a sidewall having a generally cylindrical outer surface, a head having a generally planar top surface, and a bottom;

(b) a transition section integrally molded as one piece with and disposed between the sidewall and the head, wherein the entire transition section is frustoconical;

(c) a handling ring monolithically molded with the transition section, the handling ring having an inner surface and an outer surface, wherein the base of the handling ring forms an obtuse angle with a portion of the transition section between the sidewall and the handling ring;

(d) a first intersection formed where the handling ring inner surface meets the transition section, the first intersection being below the generally planar top surface; and (e) a second intersection formed where the handling ring outer surface meets the transition section, the second intersection being interior to the cylindrical outer surface.

13. The drum of claim 12, wherein the transition section is curved.

14. The drum of claim 12, wherein the handling ring forms an acute angle with respect to a portion of the transition section that is proximate the head.

* * * * *

UNITED STATES PATENT AND TRADEMARK OFFICE

CERTIFICATE OF CORRECTION

PATENT NO. : 6,182,853 B1
DATED : February 6, 2001
INVENTOR(S) : Robert A. Julien It is certified that error appears in the above-identified patent and that said Letters Patent is hereby corrected as shown below:

Title page,
Line 1, under "FOREIGN PATENT DOCUMENTS" change "B1 15436176" to -- AU-B1-15,436/76 --.
Line 2, under "FOREIGN PATENT DOCUMENTS" change "819446" to -- 819.446 --.
Line 4, under "FOREIGN PATENT DOCUMENTS" change "1 0 210 679" to -- 0 210 679 A1 --.
Line 6, under "FOREIGN PATENT DOCUMENTS" change "1 0 324 882" to -- 0 324 882 A1 --.

Claim 1,
Line 1, after "drum" insert -- , -- (comma).

Signed and Sealed this

Twenty-fifth Day of December, 2001

*Attest:*

*Attesting Officer*

JAMES E. ROGAN
*Director of the United States Patent and Trademark Office*